United States Patent [19]

Chessin et al.

[11] Patent Number: 4,717,456

[45] Date of Patent: Jan. 5, 1988

[54] TWO-STEP ELECTROLYTIC ACTIVATION PROCESS FOR CHROMIUM ELECTRODEPOSITION

[75] Inventors: Hyman Chessin, Brick; William C. Korbach, Howell Township, both of N.J.

[73] Assignee: M&T Chemicals, Woodbridge, N.J.

[21] Appl. No.: 816,180

[22] Filed: Jan. 6, 1986

[51] Int. Cl.[4] ..... C25D 5/26

[52] U.S. Cl. ..... 204/34; 204/51

[58] Field of Search ..... 204/34, 29, 51, 145 R

[56] References Cited

U.S. PATENT DOCUMENTS

| | | | |
|---|---|---|---|
| 2,915,444 | 12/1959 | Meyer | 204/145 |
| 3,694,326 | 9/1972 | McCabe | 204/29 |
| 3,726,773 | 4/1973 | Lamb | 204/129.35 |
| 3,840,441 | 10/1974 | Hees | 204/34 |
| 4,412,892 | 11/1983 | Chen et al. | 204/34 |
| 4,474,651 | 10/1984 | Yauchi et al. | 204/34 |

OTHER PUBLICATIONS

Metal Finishing Guidebook and Directory for 1978, Metals and Plastics Publications, Inc., Hackensack, N.J., pp. 130–132, 202–205.

F. A. Lowenheim, Electroplating, McGraw-Hill Book Co., New York, 1978, pp. 77–81, 87.

Hackh's Chemical Dictionary, McGraw-Hill Book Co., New York, 1969, p. 156.

*Primary Examiner*—John F. Niebling

*Assistant Examiner*—William T. Leader

*Attorney, Agent, or Firm*—S. H. Parker; R. E. Bright

[57] ABSTRACT

The two-step electrolytic activation process comprises anodic treatment in a polarizing solution followed sequentially by a cathodic treatment in an electrolyte solution. The activation process is useful for cast iron substrates to enable electrodeposition of chromium thereon which is adherent, bright, smooth and hard, particularly from high energy efficient chromium baths.

11 Claims, No Drawings

TWO-STEP ELECTROLYTIC ACTIVATION PROCESS FOR CHROMIUM ELECTRODEPOSITION

BACKGROUND OF THE INVENTION

1. Field of the Invention

This invention relates to electrodeposition of chromium, and, more particularly, it is concerned with an activation process by which an adherent chromium electrodeposit can be formed on a cast iron substrate from a high energy efficient chromium plating bath.

2. Description of the Prior Art

Commercial use of high energy efficiency chromium plating baths has been hampered by their inability to provide adequate coating adhesion to certain metal substrates. The baths themselves are disclosed in Mitsui, J7B-33941 (Sept., 1978): Dillenberg, U.S. Pat. No. 4,093,522: Perakh et al., U.S. Pat. No. 4,234,396: and Chessin U.S. Pat. Nos. 4,450,050 and 4,472,249.

The use of sulfuric acid and hydrofluoric acid etches for stainless steel substrates to improve adhesion has been recommended for chromium deposition. For example, a table which gives suitable lengths of time for various substrates for such an etching process, primarily in chromic acid solution, is found in "Metal Finishing" 80 (5) pages 65–8 (1982) by C. H. Peger.

Anodic chromic acid etching treatments for 400 stainless steel alloys and for low and high carbon steels is disclosed in "48th Metal Finishing Guidebook-Directory" 78, 188–202 (1980) by A. Logozzo. Also recommended are cathodic treatments in sulfuric acid-fluoride solutions for 300 stainless, nickel alloys and cast iron.

The use of a slight reverse in the plating bath after reversing in sulfuric acid is disclosed at page 136 of "Hard Chromium Plating" Robert Draper Ltd., Teddington, England (1964) by J. D. Greenwood.

ASTM B177-68 describes the use of sulfuric acid or chromic acid as an activator for chromium electroplating on steel for engineering use.

Chessin in U.S. Pat. No. 4,450,050 describes an activation pretreatment for bonding high efficiency chromium electrodeposits on a metal substrate which is characterized by the pre-step of plating the substrate metal with iron or an iron alloy from an iron salt containing bath.

Herrmann, in U.S. Pat. No. 4,416,758, activates metal substrates in an aqueous alkaline cyanide containing solution using current which is periodically reversed, followed by rinsing and chromium plating.

Chen and Baldauf, in U.S. Pat. No. 4,412,892, use an anodic treatment in a sulfuric acid-hydrochloric acid solution.

Electroplating Engineering Handbook,p. 167 Graham (Rheinhold) N.Y. (1955) suggests a dip in 1% sulfuric −0.1% hydrochloric solution, or an anodic treatment in the plating bath itself.

It has been found that when these procedures are employed with high energy efficient chromium plating baths, cast iron substrates still are not adequately plated because of poor adhesion. It can be speculated that the reducing conditions at the cathode during initiation of deposition causes the halide ion present in the high energy efficient bath to be reduced to a form which interferes with the molecular bonding of chromium to the substrate. In any event, the use of high efficiency chromium plating on cast iron has been limited by the problem of inadequate adhesion.

Accordingly, it is an object of this invention to provide an improved process for forming adherent, bright, smooth and hard chromium electrodeposits, particularly from high energy efficient chromium baths, on cast iron substrates. strates.

Still another object is to provide a two-step electrolytic activation process for cast iron metal substrates which enables electrodeposition of an adherent, bright, smooth and hard chromium metal deposit, particularly from a high energy efficient chromium bath.

SUMMARY OF THE INVENTION

It has now been found that the adherence problems encountered with the prior art systems for electrodepositing chromium on cast iron metal substrates from a high energy efficient chromium electroplating bath can be overcome by the use of a two-step activation process in which the cast iron substrate is electrolytically activated by an anodic treatment followed sequentially by a cathodic treatment.

DETAILED DESCRIPTION OF THE INVENTION

The anodic step is carried out in a polarizing solution in which the surface of the cast iron substrate is dissolved without causing surface roughness. Suitable polarizing solutions include oxidizing agents, such as a concentrated sulfuric acid solution, chromic acid, dichromate, disulfate and the like, preferably in a medium of high ionic strength, such as is provided by electrolyte salts such as sodium sulfate, potassium sulfate and magnesium sulfate.

The anodic step is carried out for a period of time sufficient to effect polarization in the solution, whereupon passivation sets in, and is terminated before surface roughness ensues. Suitably, this period is 15 seconds to 10 minutes, at a current density of about 15 to 45 amps/dm$^2$ (asd), preferably 20 to 30 asd.

When a concentrated sulfuric acid solution is used as the anodic solution, the step is preferably carried out at a lower operating temperature than with other oxidizing agents. For example, at a concentration of about 30% sulfuric acid, the temperature of the bath preferably should be less than 20° C. At concentrations of sulfuric acid higher than 30%, however, the operating temperature can be 20° C. and higher.

The cathodic treatment step is effective to reduce the passive layer (oxide layer) formed on the substrate during the anodic step. During this cathodic treatment, nascent hydrogen is produced which interacts with the oxide layer to condition it to receive the chromium electrodeposit as an adherent film.

Suitably, the cathodic activation solution is an electrolyte, such as is provided by the anodic solution itself, or an acid or alkaline medium. An alkaline solution is preferred.

A typical anodic activation solution comprises about 10 to 50% sulfuric acid, optionally with about 20 g/l or more of dichromate, and 180 g/l or more of magnesium sulfate.

A typical cathodic solution comprises a strong sodium hydroxide solution.

Preferably, between and after the activation steps, the current is turned off and the activated metal substrate is transferred to a rinsing vessel where it is rinsed free of the activation solution.

After both activation steps, the thus-activated substrate is placed in the chromium electroplating bath and chromium metal is deposited thereon. While the process of the invention can be utilized for electrodepositing chromium from any chromium bath, it is used most advantageously for forming adherent chromium deposits on cast iron substrates from a high energy efficient chromium bath, such as is described in U.S. Pat. No. 4,472,249.

Typical cast irons for use herein include nodular, grey and malleable cast irons.

The following examples will illustrate the invention more particularly.

EXAMPLE 1

An anodic polarizing solution was prepared from a 30% sulfuric acid solution to which was added 24 g/l of sodium dichromate and 216 g/l of magnesium sulfate. A nodular cast iron substrate was placed in this solution and the substrate was treated anodically at 15 asd for 2 minutes at 16° C. After rinsing, the substrate was subjected to a cathodic treatment in a strongly alkaline solution (50 g/l caustic) at 15 asd for 1 minute at 64° C., and rinsed again. The thus-activated substrate then was placed in a high energy efficient chromium bath containing iodide ion and chromium was deposited thereon at 77.5 asd for 60 minutes. The chromium layer which formed exhibited excellent adherence to the activated cast iron and was bright, smooth and hard.

In contrast, when only either one of the activation steps was used, very poor adhesion was obtained.

EXAMPLE 2

The anodic polarizing solution consisted of a 30% sulfuric acid solution containing 100 g/l of chromic acid. The substrate was grey cast iron. The anodic treatment was carried out at 15 asd for 2 minutes at 16° C., followed by rinsing. The cathodic treatment was performed in the strongly alkaline solution of Example 1 at 15 asd for 1 minute at 40° C. After rinsing, chromium was deposited at 77.5 asd for 15 minutes. Adherence of the chromium deposit to the activated substrate was excellent, and it was smooth, bright and hard.

EXAMPLE 3

The two-step activation process of Examples 1 and 2 was repeated except that the cathodic treatment was carried out in the polarizing solution itself. An excellent adhering deposit was obtained.

EXAMPLE 4

The processes of Examples 1–3 were repeated with the cathodic step preceding the anodic step. The chromium deposit was observed to adhere poorly to the substrate.

Although the invention has been described with reference to certain preferred embodiments thereof, it will be understood that changes and modifications may be made which are within the skill of the art. According it is intended to be bound only by the appended claims.

What is claimed is:

1. A method of forming adherent, bright, smooth and hard chromium electrodeposits on a cast iron substrate comprising:

(a) activating said substrate by a two-step electrolytic activation process comprising anodically treating said substrate in an oxidizing solution, to form a passive layer thereon without introducing surface roughness, and sequentially, cathodically treating said substrate, to reduce the passive layer and condition the substrate to receive an adherent chromium electrodeposit and, electrodepositing chromium on said thus-activated substrate.

2. A method according to claim 1, further including rinsing the activated substrate between said activation steps, and before electrodepositing chromium.

3. A method according to claim 1, wherein said oxidizing solution comprises an oxidizing agent selected from the group consisting of concentrated sulfuric acid, chromic acid dichromate, disulfate, and mixtures thereof.

4. A method according to claim 3, wherein said polarizing solution also includes an inorganic salt to increase its ionic strength.

5. A method according to claim 4, wherein said inorganic salt is sodium, potassium, or magnesium sulfate, or mixtures thereof.

6. A method according to claim 1, wherein said cathodic step is carried out in an alkaline or acid solution.

7. A method according to claim 1 wherein the cathodic step is carried out in said oxidizing solution.

8. A method according to claim 1, wherein said oxidizing solution consists essentially of concentrated sulfuric acid, a dichromate and magnesium sulfate.

9. A method according to claim 1, wherein said anodic treatment is carried out for about 15 seconds to 10 minutes at a current density of about 15 to 45 asd.

10. A method according to claim 1, in which said anodic treatment is carried out in about a 10 to 30% sulfuric acid solution, optionally with chromic acid and/or sodium, potassium or magnesium sulfate, at a temperature below 20° C.

11. A method according to claim 1, in which said electrodeposition of chromium is carried out from a high energy efficient chromium bath.

* * * * *